US006418633B1

(12) United States Patent
Rager

(10) Patent No.: US 6,418,633 B1
(45) Date of Patent: Jul. 16, 2002

(54) VERTICAL IN-LINE BOW SIGHT

(75) Inventor: Christopher A. Rager, Three Forks, MT (US)

(73) Assignee: Trophy Ridge, LLC, Bozeman, MT (US)

( * ) Notice: Subject to any disclaimer, the term of this patent is extended or adjusted under 35 U.S.C. 154(b) by 0 days.

(21) Appl. No.: 09/607,243

(22) Filed: Jun. 30, 2000

(51) Int. Cl.[7] ..... F41G 1/00; F41B 5/00
(52) U.S. Cl. ..... 33/265; 124/87; 42/138
(58) Field of Search ..... 33/265; 124/87; 42/136, 137, 138, 139

(56) References Cited

U.S. PATENT DOCUMENTS

| | | | | | |
|---|---|---|---|---|---|
| 3,234,651 | A | | 2/1966 | Rivers | 33/265 |
| 3,455,027 | A | * | 7/1969 | Perkins | 33/265 |
| 3,475,820 | A | * | 11/1969 | Kernan | 33/265 |
| 4,120,096 | A | | 10/1978 | Keller | 33/265 |
| 4,244,115 | A | * | 1/1981 | Waldorf | 33/265 |
| 4,977,678 | A | | 12/1990 | Sears | 33/265 |
| 5,086,567 | A | | 2/1992 | Tutsch | 33/265 |
| 5,103,568 | A | | 4/1992 | Canoy | 33/265 |
| 5,131,153 | A | | 7/1992 | Seales | 33/265 |
| 5,362,046 | A | | 11/1994 | Sims | 473/300 |
| 5,383,279 | A | | 1/1995 | Tami | 33/265 |
| 5,442,861 | A | | 8/1995 | Lorocco | 42/145 |
| 5,442,863 | A | * | 8/1995 | Fazely | 33/265 |
| 5,634,278 | A | | 6/1997 | London | 42/132 |
| 5,638,604 | A | | 6/1997 | Lorocco | 42/132 |
| 5,676,122 | A | | 10/1997 | Wiseby et al. | 124/87 |
| 5,685,081 | A | | 11/1997 | Winegar | 33/265 |
| 5,836,294 | A | * | 11/1998 | Merritt | 124/87 |
| 5,956,854 | A | | 9/1999 | Lorocco | 42/132 |
| 6,016,608 | A | | 1/2000 | Lorocco | 33/265 |
| 6,276,068 | B1 | * | 8/2001 | Sheliga | 33/265 |

OTHER PUBLICATIONS

"Cross Dot", http://montanablackgold.com/crossdot.htm, last updated May 18, 2000, one page.

* cited by examiner

*Primary Examiner*—Randy W. Gibson
(74) *Attorney, Agent, or Firm*—Merchant & Gould P.C.

(57) ABSTRACT

A bow sight having a support structure, and two or more vertically aligned vertical pins connected to the support structure is provided. At least two of the vertical pins include a sight point. In accordance with another aspect of the invention, a bow sight having a support structure connected to two or more sight points is provided. The two or more sight points are rotationally adjustable such that they can be rotated into vertical alignment. In accordance with another aspect of the invention, a bow sight having a support structure, a sight point connected to the support structure, and a dampener is provided.

33 Claims, 9 Drawing Sheets

VERTICAL IN-LINE BOW SIGHT

FIELD OF THE INVENTION

The invention relates to a sight for a bow. In particular, the bow sight includes vertical sight points. The invention also relates to vertical sight points that are rotationally adjustable for the achievement of vertical alignment despite the amount of bow torque applied by the archer to the bow. The invention also relates to a bow sight including a dampener.

BACKGROUND OF THE INVENTION

This invention relates generally to the field of archery equipment and more particularly to a novel sighting apparatus for use with an archery bow.

Bow sights generally have multiple sight points for use in shooting arrows into targets of different distances from the archer. Many bow sights include multiple sight points attached to horizontal pins. Bow sights with horizontal pins are shown in U.S. Pat. Nos. 5,103,568; 5,676,122; and 5,685,081.

A number of U.S. patents disclose bow sights having various other arrangements of sighting points. See, for example, U.S. Pat. Nos. 3,234,651; 4,120,096; 5,086,567; and 5,131,153.

SUMMARY OF THE INVENTION

A bow sight having a support structure, and two or more vertically aligned vertical pins connected to the support structure is provided. At least two of the vertical pins include a sight point.

In accordance with another aspect of the invention, a bow sight having a support structure connected to two or more sight points is provided. The two or more sight points are rotationally adjustable such that they can be rotated into vertical alignment.

In accordance with another aspect of the invention, a bow sight having a support structure, a sight point connected to the support structure, and a dampener is provided.

BRIEF DESCRIPTION OF THE DRAWINGS

FIGS. 10*a–d* are a rear view, front view, left view and right view respectively of a vertical pin according to the principles of the present invention.

DETAILED DESCRIPTION OF THE PREFERRED EMBODIMENT

In the following description of the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
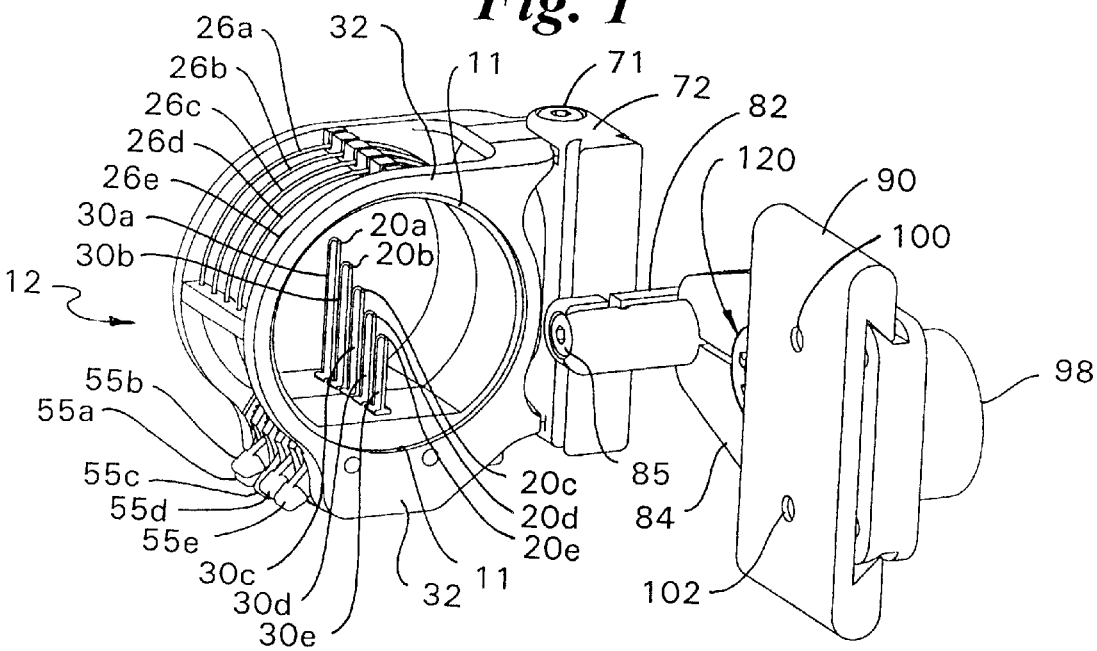
FIG. 1 is a perspective view of a bow sight according to the principles of the present invention.
Figure 2:
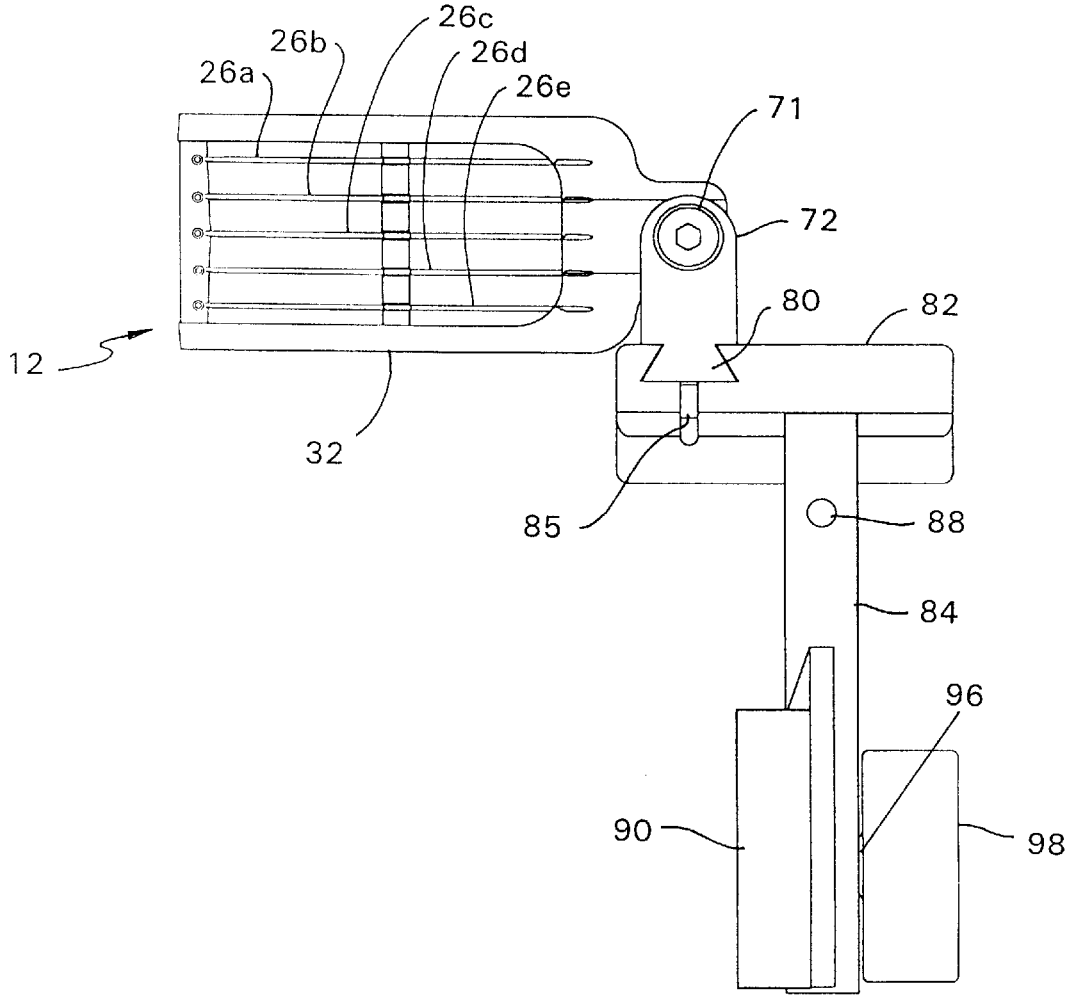
FIG. 2 is a top view of a bow sight according to the principles of the present invention.

A bow sight is a device that is attached to an archery bow and which provides one or more sight points. The archer uses the sight point(s) to aim at the target. A peep sight may be placed on the string of the bow such that the archer can sight through the peep sight and at the sight point with the target in the background. FIG. 1 shows a preferred embodiment of a bow sight 12. For purposes of this application, the view of the bow sight as seen from the archer in the shooting position is referred to as the front view of the bow sight.

A sighting point is any shape, point, or indicia of any sort that is visually placed in line with the target to be shot at for assisting in the proper aiming of the bow. Sight points can be circular shapes, other geometrical shapes, colored dots, the end of a light gathering cable, or simply the end of a sight pin, for example.

In a preferred embodiment, the sight points 20*a–e* are formed by the ends of the fiber optic cables 26*a–e*. The fiber optic cables 26*a–e* collect light along their lengths and the light exits the end of the cables 26*a–e*. In this preferred embodiment, the ends of the fiber optic cables 26*a–e* are held in place by vertical pins.

A vertical pin is a member having a vertically elongated portion, wherein that member supports a sight point and wherein the sight point may be integral with or a separate piece from the vertical pin. A vertical pin could include features in addition to the fact that it has a length that is vertical. For example, a vertical pin could be an L-shaped pin with the horizontal portion of the L-shape extending in the direction toward the archer in the shooting position. See FIG. 8 for an example of an L-shaped pin that falls within the definition of a vertical pin.

Vertical pins have a significant advantage over horizontal pins because the field of view to the right and left of the vertical pins is very open for viewing the target and the environment of the target area.

In a preferred embodiment, the vertical pins 30*a–e* are linear vertical pins that define a hole in the uppermost end for receiving the ends of the fiber optic cables 26*a–e*.

In another preferred embodiment, the vertical pins are linear vertical pins that do not define a hole in the uppermost end. In this embodiment, the ends of the fiber optic cables 26*a–e* are glued or crimped to the ends of the vertical pins 30*a–e*.

A support structure is any structural member that supports a sight point. In a preferred embodiment, the support structure 32 is a generally circular shaped piece of acrylic that supports the vertical pins 30*a–e* which support the sight points 20*a–e* respectively. The circular shape of the support structure 32 provides protection of the vertical pins 30*a–e* from being damaged or bent while also providing a good view of the ultimate target through the interior portion of the circular support structure.

The point at which a vertical pin is attached to a support structure is the attachment point. Vertical pins can be attached to the support structure in many different orientations. Vertical pins can be attached to the support structure with the sight point below the attachment point or with the sight point above the attachment point. It is also within the scope of the present invention to have a bow sight with one or more vertical pins attached to the support structure with the sight point below the attachment point and one or more vertical pins attached to the support structure with the sight point above the attachment point.

It is often desired to adjust the sight point height associated with a particular vertical pin. These adjustments are made to "sight-in" the bow so that each sight point is accurately associated with a target of a particular distance. A vertical pin is "vertically adjustable" when the associated sight point for that vertical pin can be moved vertically up or down.

Figure 9:
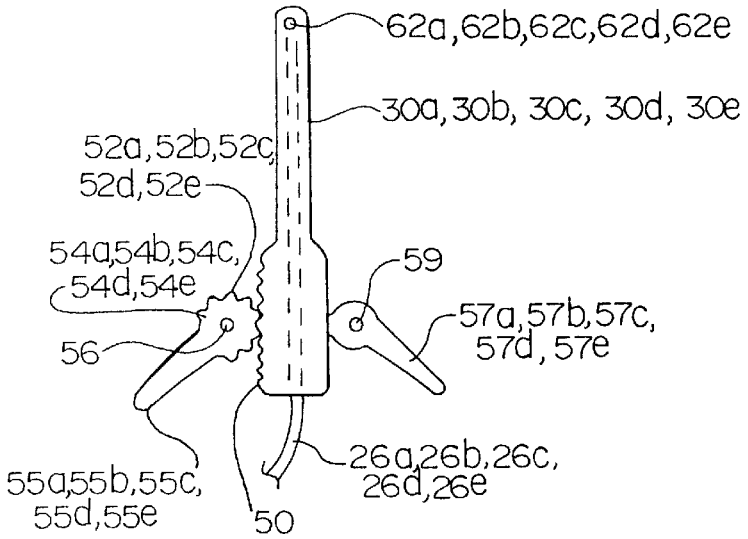
FIG. 9 is an exploded view of a vertical pin, an associated adjustment knob and an associated cam member according to the principles of the present invention.
Figure 9:
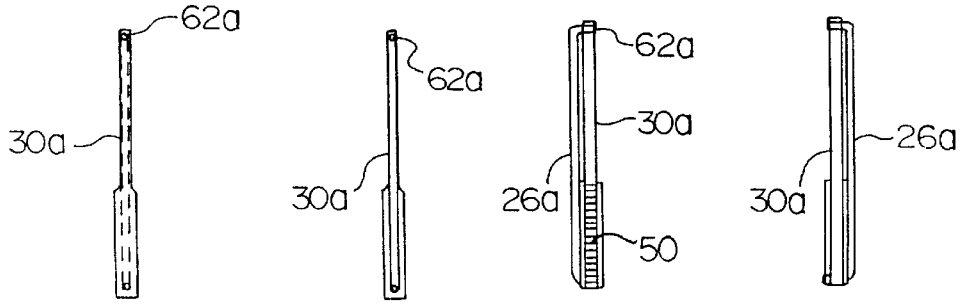

In a preferred embodiment, each of the vertical pins 30*a–e* is vertically adjustable by movement of the entire vertical pin. Each of the vertical pins 30*a–e* include gears, such as gears 50 on vertical pin 30*a* as shown in FIG. 9. Likewise, the adjustment knobs 54*a–e* each include gears, such as gears 52 on adjustment knob 54*a* as shown in FIG. 9. The gears on vertical pins 30*a–e* interact respectively with the gears on the adjustment knobs 54*a–e* such that rotation of an adjustment knob results in linear vertical motion of the respective vertical pin. The adjustment knobs 54*a–e* also include levers 55*a–e* respectively. The levers 55*a–e* are each integral with the corresponding adjustment knobs 54*a–e*. The lever makes it easier to rotate the adjustment knob.

Figure 6:
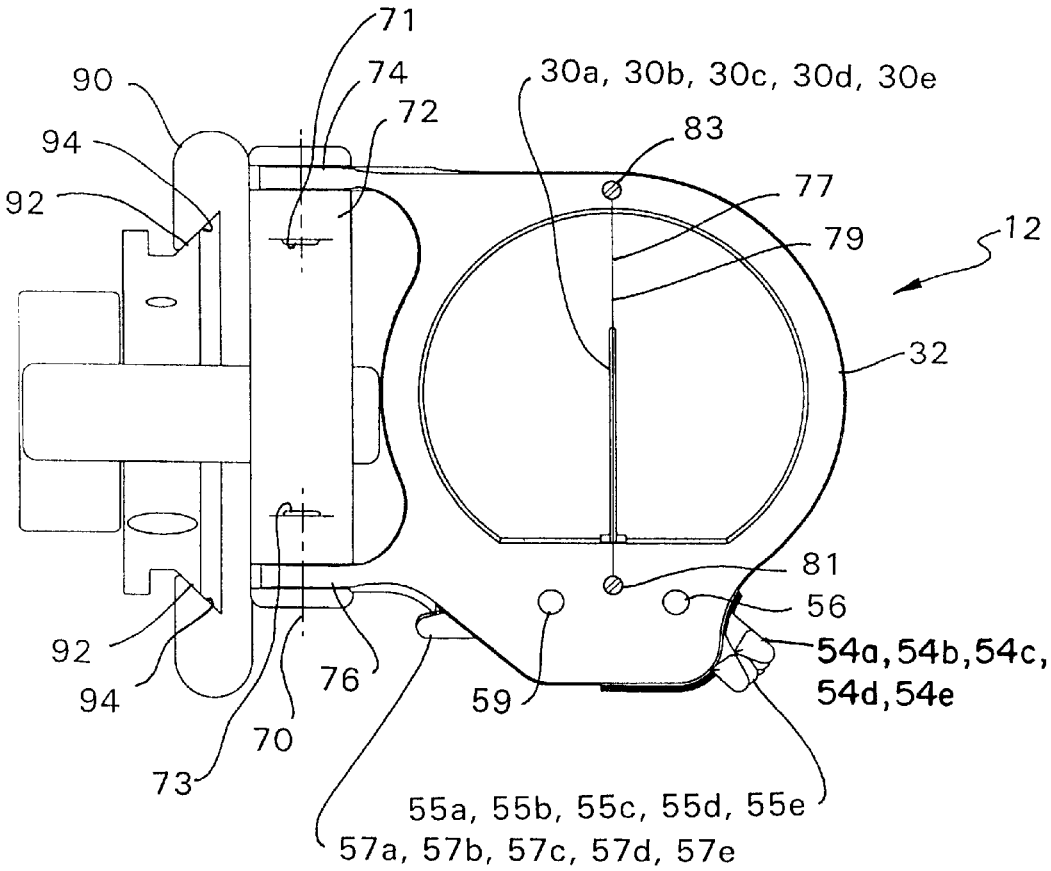
FIG. 6 is a back view of a bow sight according to the principles of the present invention and including a bow torque indicator.

As shown in FIG. 6, axis rod 56 extends through the center axis of the adjustment knobs 54*a–e*. The adjustment knobs 54*a–e* rotate around the axis rod 56.

The cam members 57*a–e* allow the archer to lock the vertical position of each vertical pin 30*a–e* respectively. The cam members 57*a–e* each comprise a cam portion 61*a–e* that rotates about an axis rod 59. Rotation of a cam member 57*a–e* results in engagement or disengagement of the respective cam portion 61*a–e* with the side of the vertical pin opposite the gears 50. This camming action allows the archer to prevent the vertical pins from moving once their vertical height is properly set.

In order to adjust the vertical position of a pin, the archer rotates the corresponding cam member, makes an adjustment of the vertical height of the pin by rotating the adjustment lever, and then rotates the cam member back into engagement with the vertical pin to hold the new vertical position. Once the pins are adjusted to the proper vertical position, it is of great importance that they not be accidentally moved. The cam members 57*a–e* accomplish this purpose by preventing rotation of the adjustment knobs 54*a–e* respectively.

Other means for preventing rotation of the adjustment knobs are contemplated. For example, a screw could be used in place of cam members 57*a–e*. Such screws (not shown) would extend perpendicular to the vertical pins and would extend through a hole in the support structure 32. Tightening of the screw associated with the vertical pin 30*a*, for example, would secure the vertical position of the sight point on vertical pin 30*a*. To adjust the height of vertical pin 30*a*, the associated screw is loosened and the adjustment knob 55*a* rotated.

In a preferred embodiment of the invention, the end of a light gathering cable is used as the sight point. A light gathering cable is any cable that collects light along the perimeter of its length and projects the light out the end of the cable. As discussed above, in a preferred embodiment, the light gathering cable is a fiber optic cable.

Figure 7:
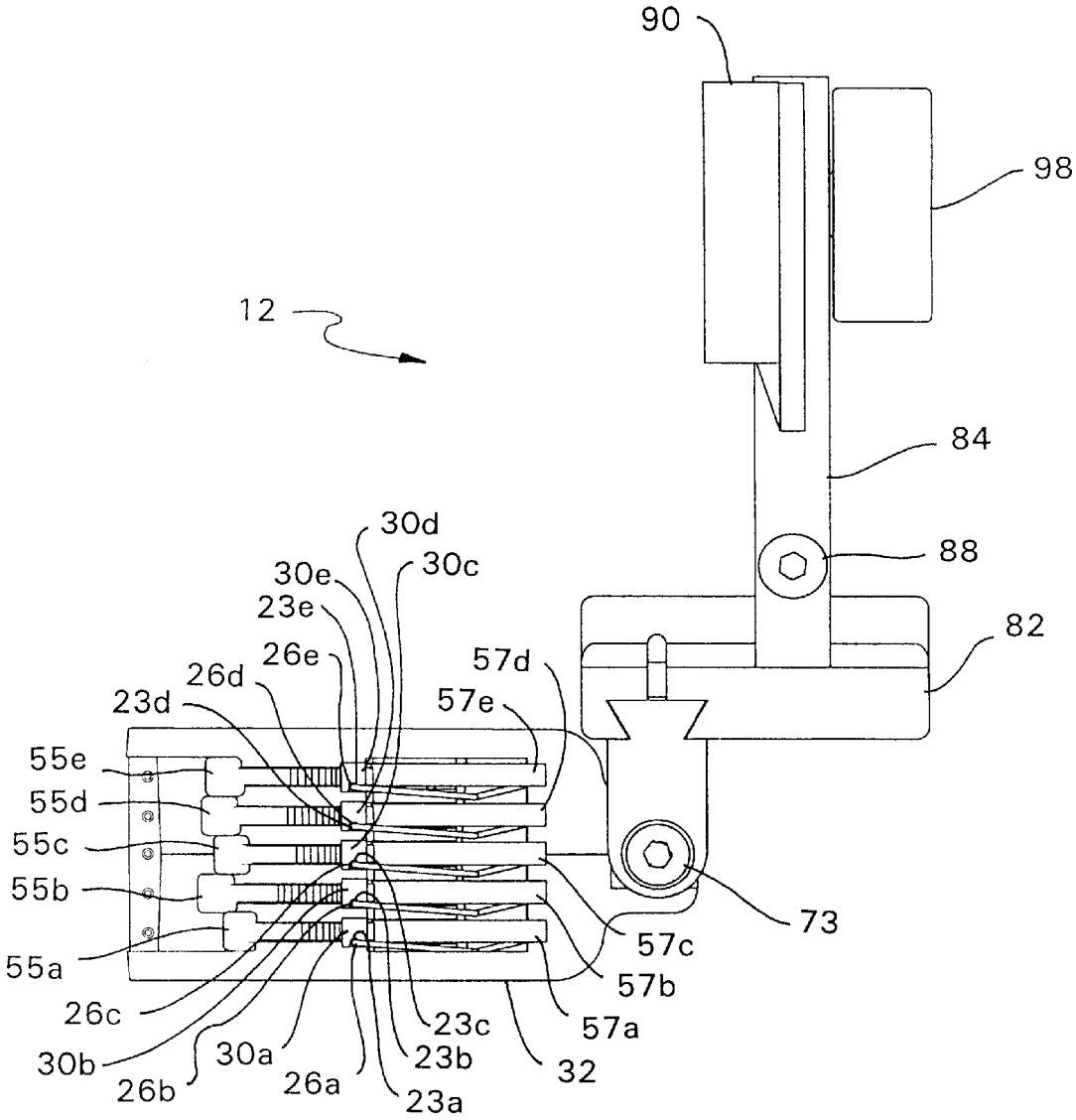
FIG. 7 is a bottom view of a bow sight according to the principles of the present invention.

Fiber optic cables 26*a–e* are mounted around the perimeter of the support structure 32 as shown in FIGS. 1, 2, 4, 5 and 7. As shown in FIG. 7, the fiber optic cables 26*a–e* extend within grooves 23*a–e* in the vertical pins 30*a–e*. The fiber optic cables are bent 45–90 degrees such that the end of the light gathering cables then pass through the holes 62*a–e* in the end of the vertical pins 30*a–e* respectively. The ends of the fiber optic cables 26*a–e* are the sight points in a preferred embodiment.

Each archer tends to hold a bow differently from the next. Some archers tend to torque the bow one way or another in the horizontal plane while shooting an arrow. Such bow torque brings the vertical pins 30*a–e* out of alignment and causes inaccurate shooting.

It is important that vertical alignment of the vertical pins be accomplished so that accuracy in shooting the bow with the bow sight can be achieved. Two vertical pins are "vertically aligned" when they are in a single vertical line as viewed from the position of the archer while holding the bow in the shooting position (with the string drawn). Vertical pins that do not form a single line as viewed from the archer, but that through an adjustment can be brought into a single line from the view of the archer still fall within the definition of "vertically aligned".

In a preferred embodiment, all five vertical pins 26*a–e* are vertically aligned. While the vertical pins 26*a–e* may not initially form a single line as viewed from the archer in the shooting position, the bow sight can be adjusted to bring the five pins 26*a–e* into a single line as viewed from the archer in the shooting position as will be described below.

In a preferred embodiment shown most clearly in FIG. 6, the bow torque adjustment feature is embodied in the ability to rotate the support structure 32 about a vertical axis 70. This bow torque adjustment feature allows for adjustment of bow torque to ensure vertical alignment of the vertical pins 30*a–e*. By rotating the support structure 32 around the vertical axis 70, an archer can set the bow sight 12 such that when that archer shoots the bow the vertical pins 30*a–e* all appear in a single line as viewed from the archer when shooting the bow.

In a preferred embodiment as shown in FIG. 6, the support structure 32 includes an upper sleeved arm 74 and a lower sleeved arm 76. Sleeve member 72 is rotationally connected to the support structure 32 along axis 70 by torque adjustment screw 71 and a torque adjustment screw 73 which both extend linearly along the vertical axis 70. An archer can loosen both torque adjustment screws 71 and 73 with an alien wrench (or by other means depending on the type of screw used) and then make the rotational adjustment between the sleeve member 72 and the support structure 32 as is necessary to bring the vertical pins 30*a–e* into vertical alignment in the shooting position. Once the correct rotational position is achieved, the torque adjustment screws 71 and 73 are tightened to prevent the sleeve member 72 and support structure 32 from rotating relative to one another.

FIG. 6 is a rear view of a bow sight according to the principles of the present invention. FIG. 6 includes a bow torque indicator 77 (not shown on the other drawings). A bow torque indicator is any vertical member that indicates to the archer whether there is bow torque. In a preferred embodiment as shown in FIG. 6, the bow torque indicator is a vertical wire 79 situated behind the vertical pins 30*a–e*. In a preferred embodiment, the vertical wire 79 is aircraft cable with a diameter of 0.030 inches. The vertical wire 79 is attached to the support structure by screws 81 and 83.

If bow torque is being applied to the bow, the archer will see that the vertical pins 30*a–e* are not lined up in a single vertical line with the bow torque indicating wire 79. The archer will then know that bow torque adjustment is required.

The attachment of the sleeve member 72 and support structure 32 to the bow is now described. The sleeve member 72 includes a double dove tail portion 80 that is received by a double dove tail recess in horizontal bar 82. A screw 85 allows for tightening and loosening of the sliding interaction between the double dove tail 80 and the double dove tail recess in the horizontal bar 82. The vertical position of the sleeve member 72 can therefore be adjusted relative to the horizontal bar 82. The horizontal bar 82 is received by an extender member 84 that has one end with an adjustable jaw 86 for holding and supporting the horizontal bar 82. The jaw 86 is adjustable via the screw 88. Thus, the horizontal bar 82 can be positionally adjusted horizontally from left to right as viewed from the archer in the shooting position.

The extender member 84 is releasably and adjustably connected to base 90. As shown in FIG. 6, extender 84 has a double dove tail 92 that is received by the double dove tail recess 94 of the base 90. Therefore, extender 84 is slidably received by the base 90 such that the base 90 and the extender 84 can be horizontally moved relative to one another toward and away from the archer.

Figure 3:
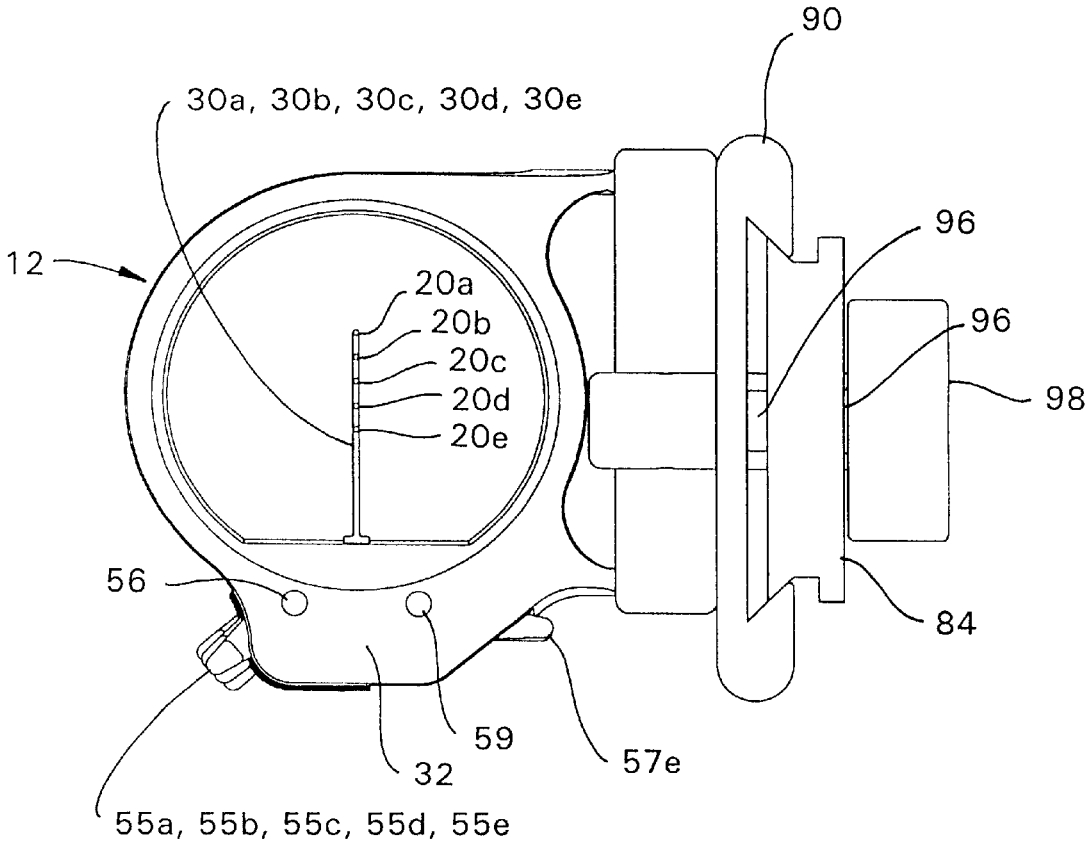
FIG. 3 is a front view of a bow sight according to the principles of the present invention.

As shown in FIG. 3, once the desired position of the extender 84 relative to the base 90 is determined, the extender 84 is nonslidably secured to the base 90 by screw 96 having adjustment knob 98. By tightening the adjustment knob 98, the screw 96 extends into a small recess (not shown) in the base 90 to prevent sliding movement between the extender 84 and the base 90.

Figure 5:
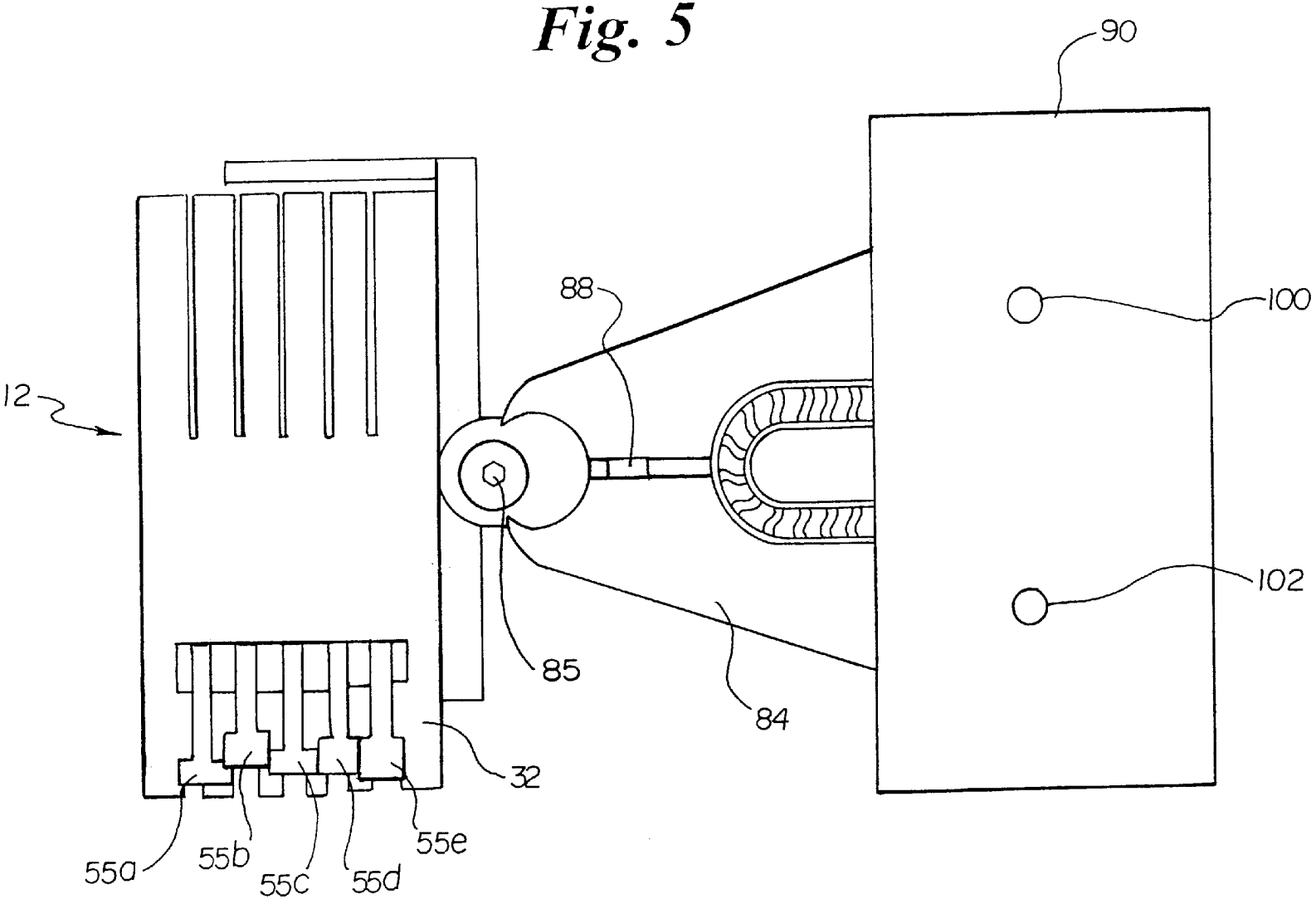
FIG. 5 is a left side view of a bow sight according to the principles of the present invention.

The base 90 is secured to the bow with two screws that pass through holes 100 and 102 and into the bow (see FIG. 5).

When the string on a bow is released, it creates significant vibrations. It is desired to reduce the vibrations for enhanced performance of the bow. In a preferred embodiment, dampeners are provided on the bow site. A dampener is any device which includes at least some material that is softer than the material that makes up the part of the bow sight to which the device is directly attached, such that the device at least partially absorbs the vibrations caused by the release of the bow string when shooting an arrow. Dampeners may be placed in the support structure itself or in any of the various members that connect the support structure to the bow.

Figure 4:
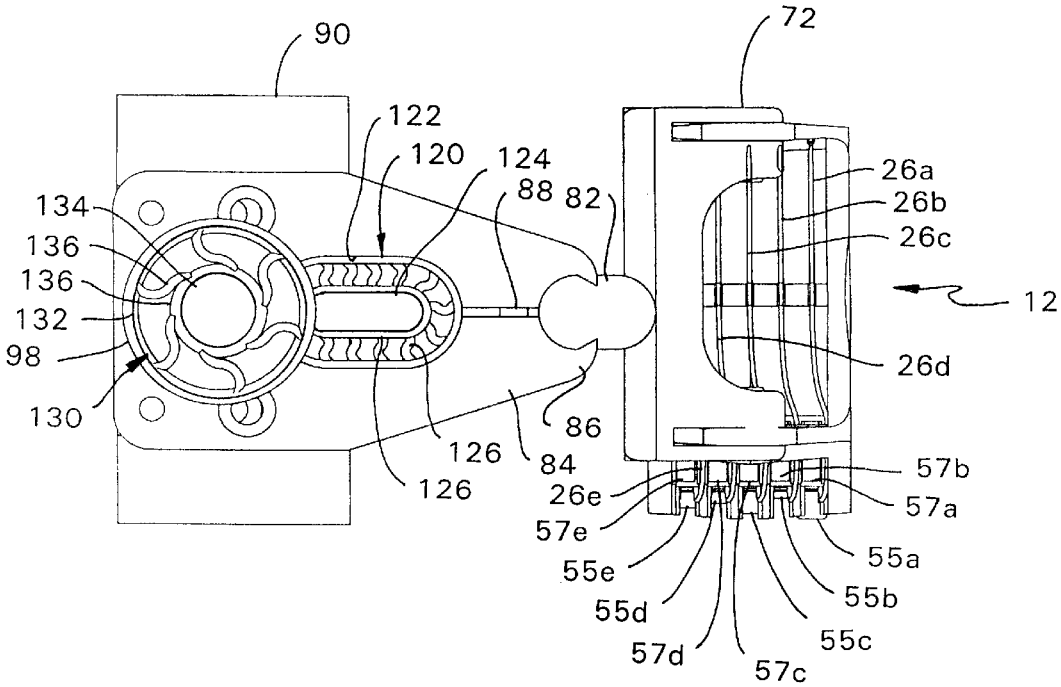
FIG. 4 is a right side view of a bow sight according to the principles of the present invention.

In a preferred embodiment shown in FIG. 4, a dampener 120 is secured in a recess 122 in the extender 84. The recess 122 and the dampener 120 are oval in shape but could be any shape. The dampener 120 comprises a brass core 124 surrounded by a webbed rubber member 126 around the perimeter of the brass core 124. Alternate materials can certainly be used for the dampener. For example, the core could be aluminum with an outer perimeter material of plastic.

In a preferred embodiment also shown in FIG. 4, dampener 130 is secured in a recess 132 in the adjustment knob 98. The dampener 130 and recess 132 in this embodiment are circular in shape but again could be any shape. The dampener 130 includes a brass core 134 and a webbed rubber member 136 around the perimeter of the brass core 134.

While particular locations of the dampeners 120 and 130 connected to the support structure 32 have been provided in the drawings, it is noted that dampeners may be connected to the support structure 32 in many different locations. For example, a dampener could be set in a recess (not shown) in the support structure 32.

Figure 8:
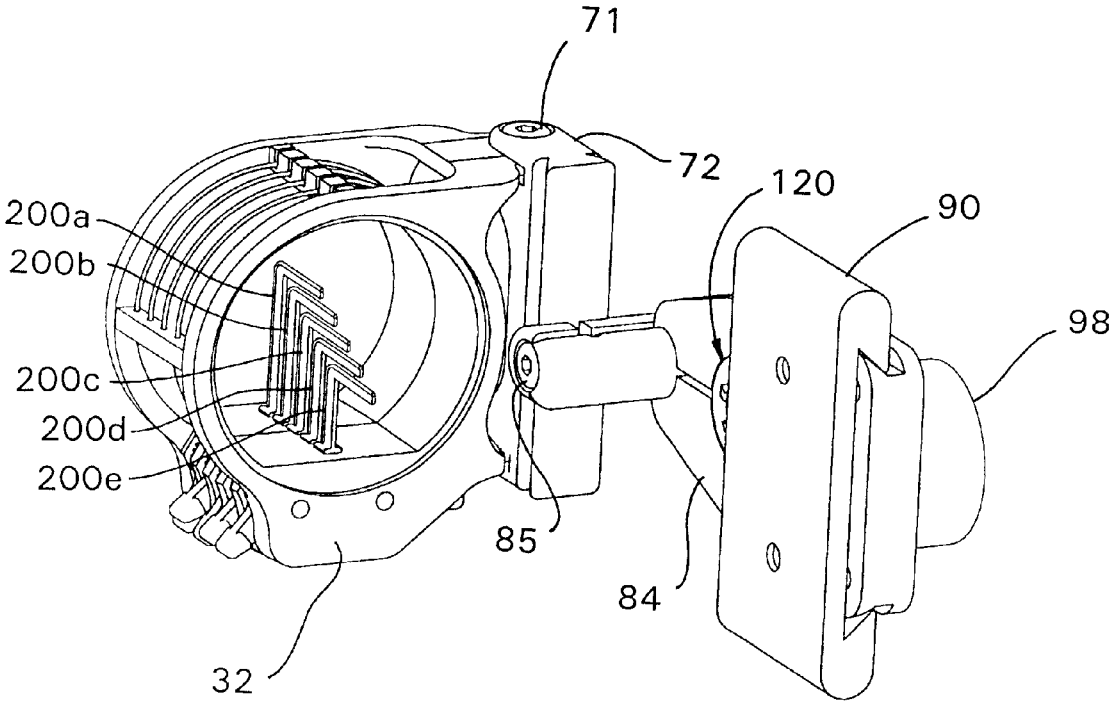
FIG. 8 is a perspective view of an alternate embodiment of a bow sight according to the principles of the present invention.

FIG. 8 is a perspective view of an alternative embodiment of the resent invention. The difference between FIG. 1 and FIG. 8 is that the vertical pins 200*a–e* in FIG. 8 are L-shaped. That is, the vertical pins 200*a–e* have a vertical portion and also a horizontal portion. The horizontal portion extends in the direction towards the archer when the archer is standing in the shooting position.

In a preferred embodiment as shown in FIG. 8, the sight points 202*a–e* associated respectively with the vertical pins 200*a–e* are all in the same vertical plane.

FIGS. 10*a–d* show a preferred embodiment of a vertical pin 30*a* from the rear, front, left and right views respectively. The fiber optic cable 26*a* can also be seen in its relationship to the vertical pin 30*a*.

It is also noted that in an alternative preferred embodiment, the vertical pins 10*a–e* are protected by a circular and planar piece of non-opaque plexiglass. The plexiglass (not shown) fits within the rim 11 of the support structure 32 (see FIG. 1). A similar piece of plexiglass may be placed on the back side of the support structure 32.

In a preferred embodiment of the bow sight of the invention, the vertical pins, pin height adjustment levers, cam lock mechanisms and the support structure are made of acrylic plastic. It should be appreciated, however, that this invention is not limited by the type of material used for its parts. Many alternative materials can be used. For example, in an alternative embodiment these parts could be made of aluminum or any other material that can structurally perform the functions of these parts.

In a preferred embodiment, the sleeve member 72, horizontal bar 82, extender 84, base 90, and adjustment knob 98 are made of aluminum.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

We claim:

1. A bow sight comprising:

(a) a support structure configured for attachment to a bow;

(b) two or more vertical pins connected to the support structure wherein at least two of the two or more vertical pins are vertically aligned when viewed by the archer holding the bow in a shooting position, and wherein at least two of the two or more vertical pins include a sight point.

2. The bow sight of claim 1 wherein each of the two or more vertical pins is vertically adjustable.

3. The bow sight of claim 2 wherein each of the two or more vertical pins include a first vertical side wherein the first vertical side of the two or more vertical pins includes gears, wherein the bow sight further comprises two or more adjustment knobs, each having a circular perimeter and a center axis, wherein each of the adjustment knobs is connected to the support structure by a pin through the center axis such that each of the two or more adjustment knobs is capable of rotating around the center axis, wherein at least a portion of the circular perimeter of each of the two or more adjustment knobs includes gears, wherein each geared adjustment knob is in geared relationship with the gears of one of the two or more vertical pins, wherein rotation of each of the two or more adjustment knobs results in vertical movement of a respective one of the two or more vertical pins.

4. The bow sight of claim 1 wherein the point at which each vertical pin is connected to the support structure is the attachment point, and wherein each of the sight points is positioned above the attachment point of the respective vertical pin.

5. The bow sight of claim 1 wherein the support structure comprises a circular shaped member wherein the circular member defines an interior and an exterior and wherein the two or more sight points are positioned within the interior of the circular member.

6. The bow sight of claim 5 wherein the point at which each vertical pin is connected to the support structure is the attachment point, and wherein each of the sight points is positioned above the attachment point of the respective vertical pin.

7. The bow sight of claim 1 wherein each of the two or more sight points is the end of a light gathering cable.

8. The bow sight of claim 1 wherein the two or more vertical pins are rotationally adjustable wherein the two or more pins can be rotated into vertical alignment.

9. The bow sight of claim 8 wherein the support structure rotates about a vertical axis wherein the rotational adjustment of the two or more vertical pins is accomplished by the rotational movement of the support structure about the vertical axis.

10. The bow sight of claim 9 wherein the support structure comprises an upper arm and a lower arm, wherein the upper arm defines a first sleeve and the lower arm defines a second sleeve, wherein the bow sight further comprises a vertical rod and a member, wherein the member defines at least a third sleeve, wherein the vertical rod is positioned at the vertical axis, and wherein the vertical rod is received in sleeved rotational relationship with the first, second and third sleeves, wherein the member is configured for attachment to a bow.

11. The bow sight of claim 10 further comprising a locking means for adjustably holding the rotational position of the support structure relative to the member in one position.

12. The bow sight of claim 10 further comprising a base having a first end and a second end, wherein the first end is configured for attachment to a bow and the second end is connected to the member.

13. The bow sight of claim 9 further comprising a bow torque indicating member connected to the support structure, the bow torque indicating member having a length, wherein the length of the bow torque indicating member is positioned vertically and wherein rotation of the support structure causes the bow torque indicating member to be in vertical alignment with the two or more sight pins.

14. The bow sight of claim 13 wherein the bow torque indicating member is a wire.

15. A bow sight comprising:

(a) a support structure configured for attachment to a bow;

(b) two or more sight points connected to the support structure, wherein the two or more sight points are rotationally adjustable and wherein the two or more sight points can be rotated into vertical alignment when viewed by the archer holding the bow in a shooting position.

16. The bow sight of claim 15 wherein the support structure rotates about a vertical axis wherein rotational adjustment of the two or more sight points is accomplished by the rotational movement of the support structure about the vertical axis.

17. The bow sight of claim 16 further comprising a member, wherein the support structure is rotatably connected to the member at the vertical axis, wherein the member is configured for attachment to a bow.

18. The bow sight of claim 17 wherein the support structure comprises an upper arm and a lower arm, wherein the upper arm defines a first sleeve and the lower arm defines a second sleeve, and wherein the member is a sleeved member which defines a third sleeve, wherein the bow sight further comprises a vertical rod positioned at the vertical axis wherein the vertical rod is received in sleeved rotational relationship with the first, second and third sleeves.

19. The bow sight of claim 17 further comprising a locking means for adjustably maintaining the rotational position of the support structure relative to the member.

20. The bow sight of claim 18 further comprising a bracket member having a first end and a second end, wherein the first end is configured for attachment to a bow and the second end is connected to the member.

21. The bow sight of claim 15 wherein each of the two or more sight points are connected to the support structure by a vertical pin.

22. The bow sight of claim 16 further comprising a bow torque indicating member connected to the support structure, the bow torque indicating member having a length, wherein the length of the bow torque indicating member is positioned vertically and wherein rotation of the support structure about the vertical axis causes the bow torque indicating member to be in vertical alignment with the two or more sight points.

23. The bow sight of claim 22 wherein the bow torque indicating member is a wire.

24. A bow sight comprising:

a support structure configured for attachment to a bow;

a sight point connected to the support structure;

a dampener connected to the support structure.

25. The bow sight of claim 24 wherein the support structure is connected to a bracket member, wherein the bracket member defines a recess, and wherein the dampener is in the recess.

26. The bow sight of claim 25 wherein the recess is oval and the dampener is oval.

27. The bow sight of claim 25 wherein the bracket member comprises a horizontal rod connected to the support structure; an extender connected to the horizontal rod; and a base connected to the extender; wherein the base is configured for attachment to a bow, wherein the extender defines a recess, and wherein the dampener is in the recess.

28. The bow sight of claim 27 wherein the bracket member further comprises a screw comprising a knob connected to a threaded screw portion for making adjustments between the extender and the base, wherein the knob defines a second recess and wherein a second dampener is positioned in the second recess.

29. The bow sight of claim 28 wherein the second recess is oval in shape and the second dampener is oval in shape.

30. The bow sight of claim 29 wherein the first and second dampeners each comprise:

a brass core comprising an outer perimeter; and an outer portion connected to the perimeter of the brass core, wherein the outer portion is rubber.

31. The bow site of claim 1 wherein at least one of the two or more vertical pins has a vertical member and another portion.

32. The bow site of claim 31 wherein at least one of the two or more vertical pins is an L-shaped pin with a horizontal portion.

33. The bow site of claim 32 wherein the horizontal portion of the L-shaped pin extends toward the archer in the shooting position.

* * * * *